US008188950B2

(12) United States Patent
Hasegawa et al.

(10) Patent No.: US 8,188,950 B2
(45) Date of Patent: May 29, 2012

(54) TEMPERATURE CONTROL FOR DISPLAY DEVICE

(75) Inventors: Hiroshi Hasegawa, Kanagawa (JP); Daisuke Kondo, Saitama (JP)

(73) Assignee: Sony Corporation, Tokyo (JP)

( * ) Notice: Subject to any disclaimer, the term of this patent is extended or adjusted under 35 U.S.C. 154(b) by 1086 days.

(21) Appl. No.: 11/984,713

(22) Filed: Nov. 21, 2007

(65) Prior Publication Data

US 2008/0143656 A1 Jun. 19, 2008

(30) Foreign Application Priority Data

Dec. 19, 2006 (JP) ..... 2006-341063

(51) Int. Cl.
*G09G 3/34* (2006.01)
*G09G 3/30* (2006.01)
*G09G 3/38* (2006.01)

(52) U.S. Cl. ..... 345/84; 345/77; 345/214

(58) Field of Classification Search ..... 345/30, 345/33, 35, 99, 100, 101, 84, 204, 77
See application file for complete search history.

(56) References Cited

U.S. PATENT DOCUMENTS 5,880,780 A * 3/1999 Sekiguchi ..... 348/241
6,496,168 B1 * 12/2002 Tomida ..... 345/76
6,683,584 B2 * 1/2004 Ronzani et al. ..... 345/8
6,831,621 B2 * 12/2004 Nakano ..... 345/87
6,975,068 B2 * 12/2005 Green et al. ..... 313/582
7,088,312 B2 * 8/2006 Ishizuka et al. ..... 345/60
7,109,990 B1 * 9/2006 Oler et al. ..... 345/428
7,123,220 B2 * 10/2006 Hanari et al. ..... 345/77
7,136,043 B2 * 11/2006 Mori et al. ..... 345/101
2005/0128169 A1 * 6/2005 Kang et al. ..... 345/87
2005/0285823 A1 * 12/2005 Kimura et al. ..... 345/76
2006/0146005 A1 * 7/2006 Baba et al. ..... 345/102
2006/0152454 A1 * 7/2006 Cok et al. ..... 345/82

FOREIGN PATENT DOCUMENTS

JP 2001-244411 9/2001
JP 2002-175046 6/2002
JP 2002-215094 7/2002
JP 2005-031430 2/2005
JP 2005-266154 9/2005
JP 2005-338294 12/2005

OTHER PUBLICATIONS

Japanese Office Action issued Nov. 25, 2008 for corresponding Japanese Application No. 2006-341063.

* cited by examiner

*Primary Examiner* — Alexander Eisen
*Assistant Examiner* — Mark Regn
(74) *Attorney, Agent, or Firm* — Rader Fishman & Grauer, PLLC

(57) ABSTRACT

A display device includes a display panel, light emitting elements, a temperature detector, and an image processing circuit. The light emitting elements are disposed in a matrix form on the display panel, a luminance of light emitting elements being controlled by a current value. The temperature detector detects a rise in temperature caused by a consumption power of a driver IC and outputs temperature information, the driver IC being configured for supplying current to the light emitting elements. The image processing circuit controls a supply current to the light emitting elements using the temperature information output from the temperature detector.

20 Claims, 15 Drawing Sheets

FIG. 4

| | | | | | | | | | | | | | | | | | |
|---|---|---|---|---|---|---|---|---|---|---|---|---|---|---|---|---|---|
| TEMPERATURE INFORMATION | DETECTED TEMPERATURE DATA OF GATE DRIVER IC3a | 0 | 1 | 0 | 1 | 0 | 1 | 0 | 1 | 0 | 1 | 0 | 1 | 0 | 1 | 0 | 1 |
| | DETECTED TEMPERATURE DATA OF GATE DRIVER IC3b | 0 | 0 | 1 | 1 | 0 | 0 | 1 | 1 | 0 | 0 | 1 | 1 | 0 | 0 | 1 | 1 |
| | DETECTED TEMPERATURE DATA OF GATE DRIVER IC3c | 0 | 0 | 0 | 0 | 1 | 1 | 1 | 1 | 0 | 0 | 0 | 0 | 1 | 1 | 1 | 1 |
| | DETECTED TEMPERATURE DATA OF GATE DRIVER IC3d | 0 | 0 | 0 | 0 | 0 | 0 | 0 | 0 | 1 | 1 | 1 | 1 | 1 | 1 | 1 | 1 |
| TEMPERATURE PROCESSING DATA (TOTAL BIT) | | 0 | 1 | 1 | 2 | 1 | 2 | 2 | 3 | 1 | 2 | 2 | 3 | 2 | 3 | 3 | 4 |

FIG. 10

| | | | | | | | | | | | | | | | | | |
|---|---|---|---|---|---|---|---|---|---|---|---|---|---|---|---|---|---|
| INPUT TEMPERATURE INFORMATION | DETECTED TEMPERATURE DATA OF GATE DRIVER IC3a | 0 | 1 | 0 | 1 | 0 | 1 | 0 | 1 | 0 | 1 | 0 | 1 | 0 | 1 | 0 | 1 |
| | DETECTED TEMPERATURE DATA OF GATE DRIVER IC3b | 0 | 0 | 1 | 1 | 0 | 0 | 1 | 1 | 0 | 0 | 1 | 1 | 0 | 0 | 1 | 1 |
| | DETECTED TEMPERATURE DATA OF GATE DRIVER IC3c | 0 | 0 | 0 | 0 | 1 | 1 | 1 | 1 | 0 | 0 | 0 | 0 | 1 | 1 | 1 | 1 |
| | DETECTED TEMPERATURE DATA OF GATE DRIVER IC3d | 0 | 0 | 0 | 0 | 0 | 0 | 0 | 0 | 1 | 1 | 1 | 1 | 1 | 1 | 1 | 1 |
| WEIGHTED TEMPERATURE INFORMATION | DETECTED TEMPERATURE DATA OF GATE DRIVER IC3a | 0.0 | 1.2 | 0.0 | 1.2 | 0.0 | 1.2 | 0.0 | 1.2 | 0.0 | 1.2 | 0.0 | 1.2 | 0.0 | 1.2 | 0.0 | 1.2 |
| | DETECTED TEMPERATURE DATA OF GATE DRIVER IC3b | 0.0 | 0.0 | 1.1 | 1.1 | 0.0 | 0.0 | 1.1 | 1.1 | 0.0 | 0.0 | 1.1 | 1.1 | 0.0 | 0.0 | 1.1 | 1.1 |
| | DETECTED TEMPERATURE DATA OF GATE DRIVER IC3c | 0.0 | 0.0 | 0.0 | 0.0 | 1.0 | 1.0 | 1.0 | 1.0 | 0.0 | 0.0 | 0.0 | 0.0 | 1.0 | 1.0 | 1.0 | 1.0 |
| | DETECTED TEMPERATURE DATA OF GATE DRIVER IC3d | 0.0 | 0.0 | 0.0 | 0.0 | 0.0 | 0.0 | 0.0 | 0.0 | 0.9 | 0.9 | 0.9 | 0.9 | 0.9 | 0.9 | 0.9 | 0.9 |
| TEMPERATURE PROCESSING DATA (TOTAL BIT) | | 0.0 | 1.2 | 1.1 | 2.3 | 1.0 | 2.2 | 2.1 | 3.3 | 0.9 | 2.1 | 2.0 | 3.2 | 1.9 | 3.1 | 3.0 | 4.2 |

TEMPERATURE CONTROL FOR DISPLAY DEVICE

BACKGROUND OF THE INVENTION

1. Field of the Invention

The present invention relates to a display device having a plurality of light emitting elements disposed in a matrix form on a display panel, the luminance of each light emitting element being controlled by a current value, and more particularly to a display device and an electronic apparatus capable of controlling the temperature of a display panel with a simple configuration.

2. Description of Related Art

In a display device having a large number of light emitting elements disposed in a matrix form on a display panel, the luminance of each light emitting element being controlled by a current value, it is generally required to increase a value of current to be supplied to each light emitting element in order to obtain a high luminance. However, as the current value is increased, the light emitting element generates heat, shortening a lifetime of the element.

An emission efficiency of a light emitting element has improved in recent years, and a signal level in an ordinary image display state is reduced by more than half of a signal level presenting a maximum luminance. The lifetime of a light emitting element is therefore rarely shortened by heat generation. However, for example, in the worst state that a full white display state continues for a long time, a light emitting element may generate heat and be damaged.

In order to settle this issue, there has been proposed a display device (e.g., refer to Japanese Unexamined Patent Application Publication No. 2005-31430 (hereinafter referred to as "patent document 1")) in which an operational environment temperature of a display panel is detected, and when this temperature exceeds a predetermined temperature (e.g., 50° C.), a drive voltage value of a light emitting element is changed and each light emitting element is driven to make a luminance value of the light emitting element lower than a predetermined luminance value.

In another display device (e.g., refer to Japanese Unexamined Patent Application Publication No. 2002-175046 (hereinafter referred to as "patent document 2")), a temperature detector is provided to each of a number of organic electro luminescence elements (hereinafter called "organic EL element") serving as light emitting elements and disposed in a matrix form, and emission control of each organic EL element is performed using temperature data detected with each temperature detector.

Of known display devices, the display device described in the patent document 1 detects the operational environment temperature of the display panel. Therefore, a change in the operational environment temperature is small, for example, even if the light emitting elements generate heat because a full white display state continues, and it is difficult to immediately detect a temperature rise in the light emitting elements. It is therefore impossible to perform efficient temperature control of the display panel and suppress the light emitting elements from being damaged by heat generation.

The display device described in the patent document 2 provides the temperature detector to each of the number of organic EL elements. Therefore, although a temperature rise in the organic EL elements can be detected immediately and controlled properly, there is a fear that the structure becomes complicated and a cost of the display device rises.

SUMMARY OF THE INVENTION

The present invention addresses the above-described issue to provide a display device and an electronic apparatus capable of efficiently controlling a temperature of a display panel with a simple configuration.

In accordance with a first aspect of the present invention, there is provided a display device including: a display panel; a plurality of light emitting elements disposed in a matrix form on the display panel, a luminance of each of the light emitting elements being controlled by a current value; detecting means for detecting an exothermic temperature caused by a consumption power of a driver IC and outputting temperature information, the driver IC being for supplying current to the light emitting elements; and an image processing circuit for controlling a supply current to the light emitting elements using the temperature information output from the detecting means.

With this arrangement, the detecting means detects an exothermic temperature caused by consumption power of driver IC for supplying current to the plurality of light emitting elements disposed in a matrix form on the display panel, a luminance of each light emitting element being controlled by a current value, and outputs temperature information. Then, the image processing circuit controls a supply current to the light emitting elements using the temperature information output from the detecting means.

In accordance with a second aspect of the present invention, there is provided an electronic apparatus which has a display device including: a display panel; a plurality of light emitting elements disposed in a matrix form on the display panel, a luminance of each of the light emitting element being controlled by a current value; detecting means for detecting an exothermic temperature caused by a consumption power of driver IC and outputting temperature information, the drive IC being for supplying current to the light emitting elements; and an image processing circuit for controlling a supply current to the light emitting elements using the temperature information output from the detecting means.

With this arrangement, the detecting means detects an exothermic temperature caused by consumption power of driver IC for supplying current to the plurality of light emitting elements disposed in a matrix form on the display panel, a luminance of each light emitting element being controlled by a current value, and outputs the temperature information, and the image processing circuit controls a supply current to the light emitting elements using the temperature information output from the detecting means.

According to the first aspect of the present invention, it is possible to detect immediately heat generation caused by an increase in the supply current, as an exothermic temperature caused by consumption power of the driver IC. Temperature control of the display device can therefore be performed efficiently, the display panel otherwise raising the temperature by heat generation of the light emitting elements. Further, since the exothermic temperature caused by consumption power of the driver IC is detected, it is not necessary to provide a temperature detector to each of the light emitting elements disposed in a matrix form, as known in the art, and the structure of the temperature detecting means can be simplified. Furthermore, since a temperature sensor or the like is not required to be mounted on the display panel, such a temperature sensor does not hinder thinning the display panel. This is effective for an organic EL display panel characterized in its thinness.

The drive IC may be provided to correspond to each of a plurality of areas of the display panel divided along a horizontal direction, and drive the light emitting elements in the divided area. By employing the driver IC, the number of driver IC may be increased by increasing the number of divisions of the display panel along the horizontal direction.

Accordingly, a precision of position information of the display panel may be improved so that temperature control of the display panel can be performed efficiently.

The detecting means may include a thermosensitive unit for detecting an exothermic temperature of the driver IC. By employing the thermosenstive unit, a consumption power of the driver IC may be detected as an exothermic temperature of the driver IC. It is therefore possible to perform temperature control of the display panel by detecting the exothermic temperature of the driver IC.

The thermosensitive unit may have a diode structure changing a forward voltage drop with a temperature. By employing the thremosensitive unit, it is possible to design in a manner that a temperature rise in the driver IC becomes equal to a temperature rise in the thermosensitive unit of the temperature detecting means. Further, since the thermosensitive unit can be formed at the same time when the driver IC is manufactured, the number of components can be reduced and the number of assembly processes may be reduced. Furthermore, since the thermosensitive unit may be formed in the driver IC, a temperature detection sensitivity of the driver IC can be improved, and a temperature control precision of the display panel can be improved.

The detecting means may include a consumption power detecting circuit, provided in a drive current input portion to the driver IC, for detecting a consumption power of the driver IC. By employing the consumption power detecting circuit, a consumption power of the driver IC may be detected directly, and a detection sensitivity can be improved. A temperature control precision of the display panel can therefore be improved further.

The image processing circuit may control the supply current to the light emitting elements by controlling one or both of an amplification factor for image data and an emission time of the light emitting elements using the temperature information output from the detecting means. According to the image processing circuit, a supply current to the light emitting elements may be controlled by an amplification factor for the image data and an emission time of light emitting elements. A temperature rise in the display panel can, therefore, be suppressed by suppressing heat generation of the light emitting elements.

Each of the light emitting elements may be an organic electro luminescence element. By employing the organic electro luminescence element, it is possible to prevent destruction of the light emitting elements to be caused by thermorunaway, and to prolong a lifetime of the display panel.

According to the second aspect of the present invention, it is possible to detect immediately heat generation of the light emitting elements caused by an increase in a supply current, as an exothermic temperature caused by consumption power of the driver IC. It is therefore possible to efficiently perform temperature control of the display panel of the display device whose temperature is raised by heat generation of the light emitting elements. Further, since an exothermic temperature caused by consumption power of the driver IC is detected, it is not necessary to provide a temperature detector to each of the light emitting elements disposed in a matrix form, as known in the art, and to simplify the structure of the temperature detecting means. Furthermore, since a temperature sensor or the like is not required to be mounted on the display panel of the display device, the temperature sensor or the like does not hinder thinning the display panel. This is effective for an organic EL display panel characterized in its thinness. A reduction in electronic apparatus thickness may be realized therefore.

BRIEF DESCRIPTION OF THE DRAWINGS

FIG. 4 is an illustrative diagram showing an example of the structure of a look-up table to be used for temperature control of the display panel.

FIG. 7A illustrates temperature control by adjusting an amplification factor for image data, and FIG. 7B illustrates temperature control by adjusting an emission time.

FIG. 10 is an illustrative diagram showing another example of the structure of the look-up table shown in FIG. 4.

DETAILED DESCRIPTION OF THE EMBODIMENTS

Figure 1:
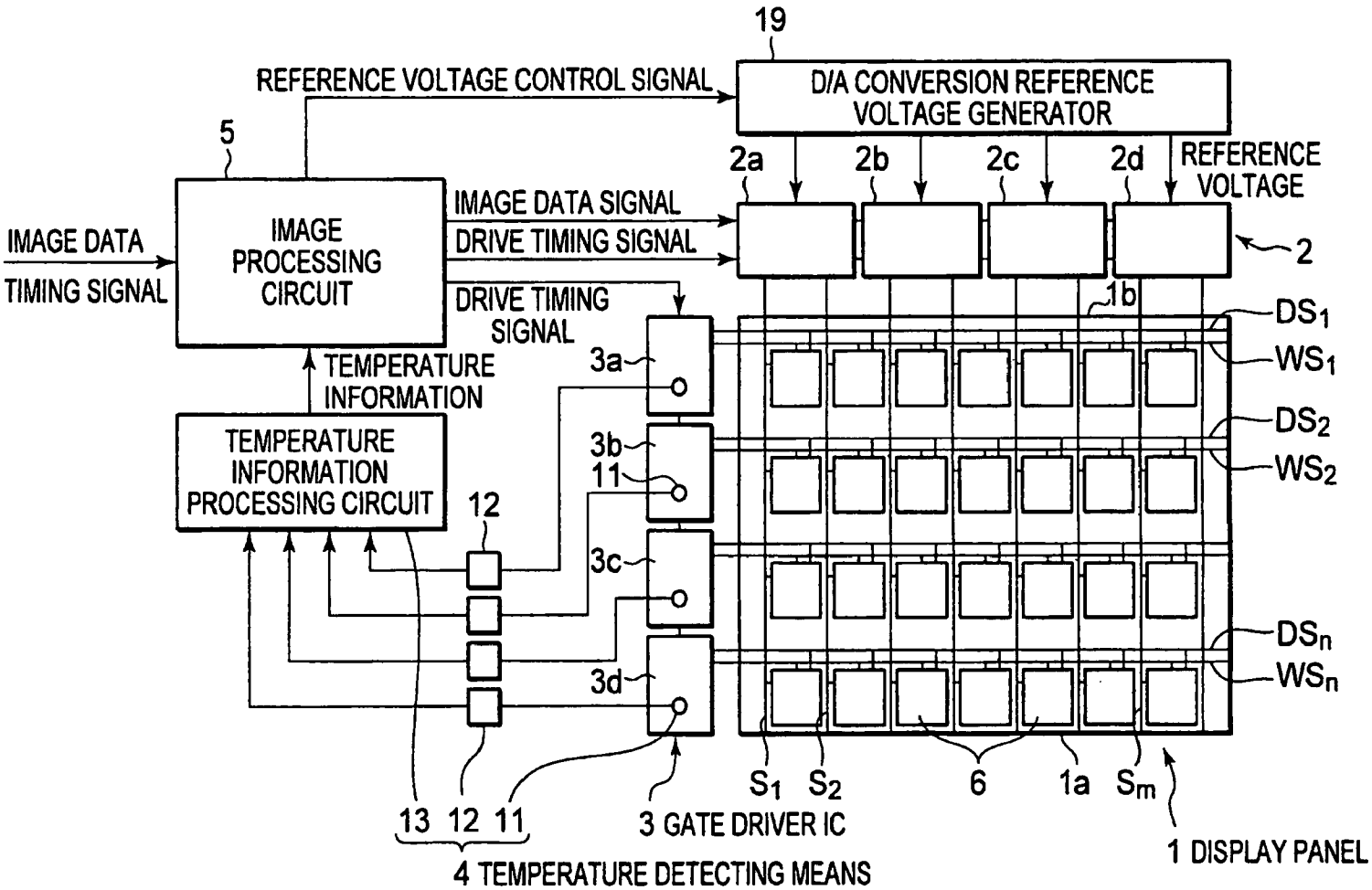
FIG. 1 is a block diagram showing a display device according to an embodiment of the present invention.

Embodiments of the present invention will now be described with reference to the accompanying drawings. FIG. 1 is a block diagram showing a display device according to an embodiment of the present invention. The display device includes a plurality of (a large number of) light emitting elements disposed in a matrix form, a luminance of each of the light emitting element being controlled by a current value. The display device has a display panel 1, data driver ICs 2, gate driver ICs 3, temperature detecting means 4, and an image processing circuit 5. In the following description, organic EL elements are used as light emitting elements.

Figure 2:
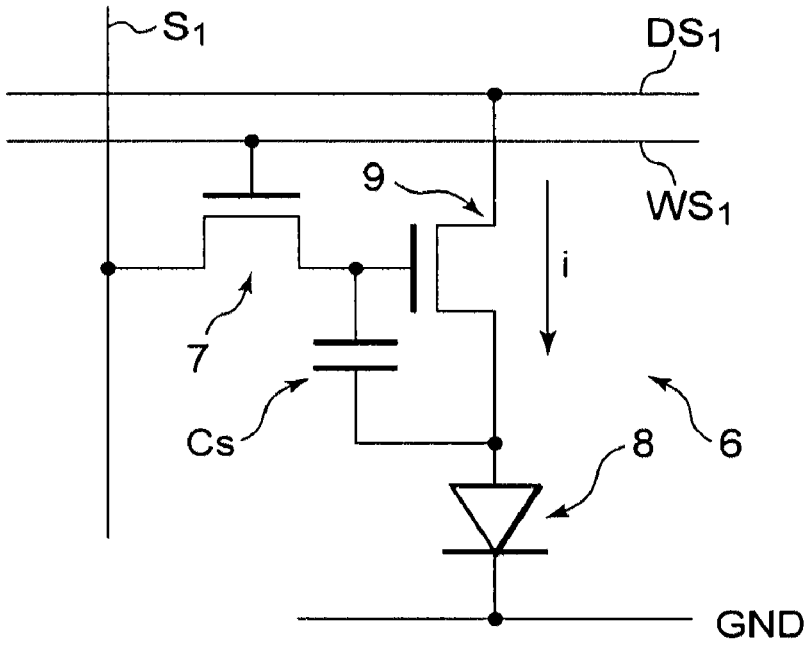
FIG. 2 is a circuit diagram of a pixel circuit formed on a display panel of the display device.
Figure 3:
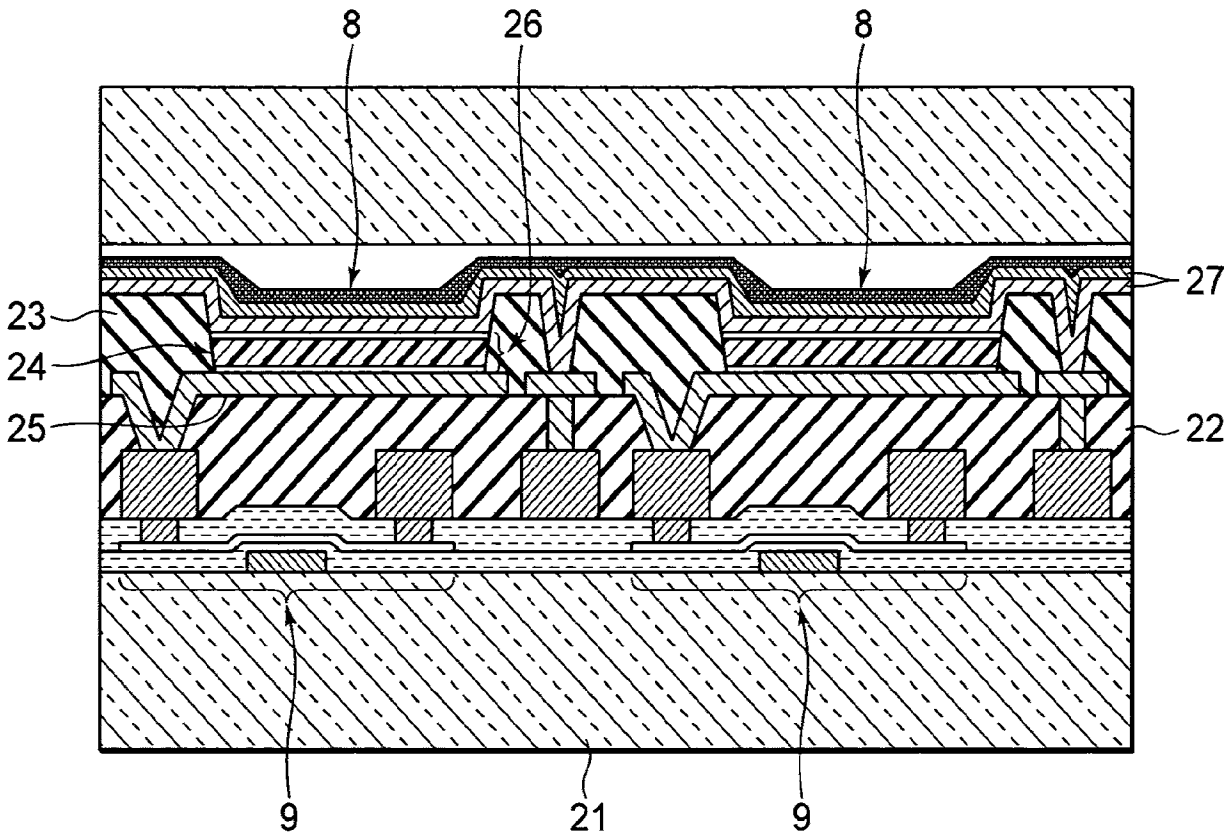
FIG. 3 is a cross sectional view of the pixel circuit.

The display panel 1 has m x n organic EL elements disposed in a matrix form. A pixel circuit 6 is provided at each cross point between two types of scan lines $WS_1$, $WS_2$, . . . , $WS_n$ and $DS_1$, $DS_2$, . . . , $DS_n$ for selecting organic EL elements of one row from a number of organic EL elements, and signal lines S1, S2, . . . , $S_m$ for supplying an image data signal. As shown in FIG. 2, the pixel circuit 6 is composed of: a holding capacitor $C_s$ for holding an image data signal; an N-MOS write transistor 7 driven by a corresponding one of the scan lines $WS_1$ to $WS_n$ and making the holding capacitor $C_s$ hold the image data signal; and an N-MOS pixel transistor 9 for driving an organic EL element 8. As shown in FIG. 3, an insulating film 22 and a window insulating film 23 are formed above a glass substrate 21 formed with the write transistors 7, pixel transistors 9 and the like, and the organic EL element 8 is formed in a recess 24 of the window insulating film 23. The organic EL element 8 is constituted of: an anode electrode 25 made of metal or the like and formed on the bottom of the recess 24 of the window insulating film 23: an organic layer 26 composed of an electron-injecting layer, an electron-transporting layer, a light-emitting layer, a hole-transporting layer, and a hole-injecting layer; and a cathode electrode 27 formed on the organic layer 26 and made of a transparent conductive film or the like formed in common for all pixels. Although the organic layer 26 employs a five-layer structure in the embodiment, there are other multi-layer structures or simple-layer structure of light-emitting layer between the anode and cathode. The multi-layer structure includes a two-layer structure composed of light-emitting layer (electron-transporting layer) and hole-transporting layer, a three-layer structure composed of an electron-transporting layer, a light-emitting layer, and a hole-transporting layer, or the like.

The organic layer 26 of the organic EL element 8 is formed by sequentially depositing on the anode electrode 25 a hole-injecting layer, a hole-transporting layer, a light-emitting layer, an electron-transporting layer and an electron-injecting layer. As current flows through the organic layer 26 via the pixel transistor 9 and anode electrode 25 shown in FIG. 3, light emits while electrons and holes are recombined.

In a specific example of the structure of the pixel circuit 6 of this embodiment, as shown in FIG. 2, the write transistor 7 has a gate connected to the scan line $WS_1$, a source connected to the signal line $S_1$ and a drain connected to the gate of the pixel transistor 9. The pixel transistor 9 has a drain connected to the scan line $DS_1$. The holding capacitor $C_s$ is connected across the gate and source of the pixel transistor 9. The organic EL element 8 has an anode connected to the source of the pixel transistor 9 and a cathode connected to ground (GND). Other pixel circuits 6 have similar structures.

The data driver ICs 2 are wired to the signal lines $S_1$ to $S_m$ of the display panel 1. The data driver IC's 2 selectively supply image data signals corresponding to luminance information to the signal lines $S_1$ to $S_m$, and D/A convert and output the image data signals of a digital image at predetermined timings. Each of the data driver ICs 2 is provided for each area of a plurality of areas dividing the display panel 1 along a vertical direction. In FIG. 1, for the purposes of simplicity, four data driver ICs 2*a* to 2*d* are shown.

The gate driver ICs 3 are wired to the scan lines $WS_1$ to $WS_n$ and $DS_1$ to $DS_n$ of the display panel 1. The gate driver ICs 3 selectively drive the two types of scan lines $WS_1$ to $WS_n$ and $DS_1$ to $DS_n$ at predetermined timings and can select the organic EL elements 8 of one row. Each of the gate driver ICs 3 is provided for each area of a plurality of areas dividing the display panel 1 along a horizontal direction, and drives the organic EL elements 8 in each area by flowing current therethrough. In FIG. 1, for the purposes of simplicity, four gate driver ICs 3*a* to 3*d* are shown.

The temperature detecting means 4 is provided to allow an exothermic temperature caused by power consumption in each gate driver IC 3 to be detected. The temperature detecting means 4 detects an exothermic temperature of a corresponding one of the gate driver IC's 3*a* to 3*d*, and generates and outputs temperature information for controlling a temperature of the display panel 1. As shown in FIG. 1, the temperature detecting means is constituted of: a chip temperature monitor circuit 11 provided in each of the gate driver ICs 3*a* to 3*d*; an A/D converter 12 for converting an analog signal output from the chip temperature monitor circuit 11 into a digital signal and outputting the digital signal as detection data; and a temperature information processing circuit 13 for processing the detection data and outputting the processed data as temperature information. The chip temperature monitor circuit 11 is formed in such a manner that a temperature rise in a thermosensitive unit 15 to be described later becomes approximately equal to a temperature rise in each gate driver IC 3.

With this arrangement, for example, if a supply current i (refer to FIG. 2) to the organic EL element 8 increases in a full white display state, if a power consumption of the gate driver ICs 3 increases, and if the gate driver IC's 3 generate heat and raise their temperatures, then the chip temperature monitor circuits 11 detect exothermic temperatures of the gate driver ICs 3, process the input detection data to generate temperature information of a plurality of bits. It is therefore possible to detect the power consumption of the gate driver ICs 3 by using the exothermic temperatures of the gate driver ICs 3 as a substitute for the power consumption having a high correlation with the exothermic temperature.

Detection data supplied from each chip temperature monitor circuit 11 is data of one bit, for example, taking "1" when a temperature is high as compared to a predetermined threshold value and "0" when a temperature is low. Therefore, if four gate driver ICs 3 are used as shown in FIG. 1, the temperature information processing circuit 13 outputs temperature information of four bits. As shown in a matrix of FIG. 4, this temperature information has sixteen combinations of bits, and contains temperature processing data having a total bit of "0" to "4". The number of gate driver ICs is not limited to four, but any number may be set. The larger the number, a precision of position information of the display panel 1 along the vertical direction becomes higher.

Figure 5:
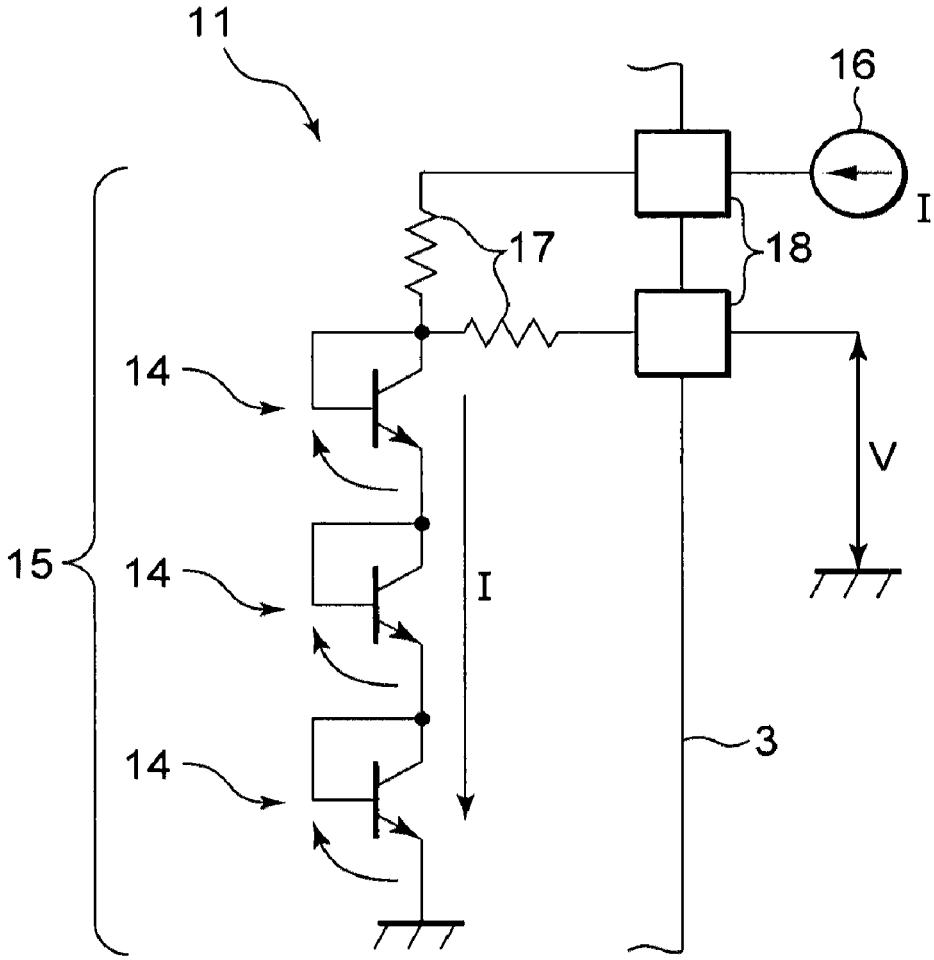
FIG. 5 is a circuit diagram showing an example of the structure of a chip temperature monitor circuit for detecting a temperature of a gate driver IC which drives the pixel circuit.
Figure 6:
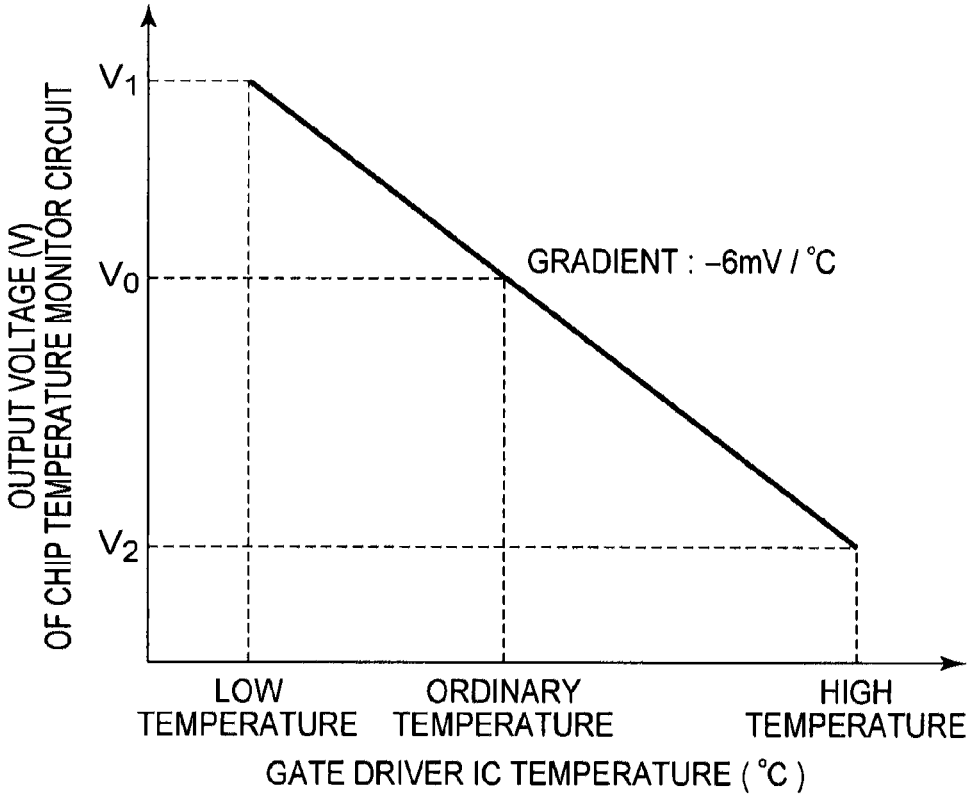
FIG. 6 is a graph showing the temperature characteristics of the chip temperature monitor circuit.

FIG. 5 shows a specific example of the structure of the chip temperature monitor circuit 11. As shown in FIG. 5, in the chip temperature monitor circuit 11, the thermosensitive unit 15 is composed of, for example, a serial connection of a plurality (in FIG. 5, three) of diode-connected PNP transistors 14 with the base and collector being short circuited. By flowing a constant current I from a constant current source 16, a temperature change in a forward voltage drop of the thermosensitive unit 15 is detected. A forward voltage drop of a PN junction diode is 0.7 V and temperature characteristics are −2 mV/° C. A serial connection of three PN junction diodes has therefore the temperature characteristics of −6 mV/° C. As shown in FIG. 6, an output voltage of the chip temperature monitor circuit 11 linearly lowers as a temperature of the gate driver IC 3 rises. In FIG. 5, reference numeral 17 represents a resistor element, and reference numeral 18 represents a terminal electrode.

The image processing circuit 5 is provided being wired to the data driver ICs 2, gate driver ICs 3 and temperature detecting means 4. The image processing circuit controls the supply current i to the organic EL elements 8 using the temperature information input from the temperature detecting means 4, and using the input image data and timing signals, outputs the image data signals and drive timing signals to the data driver ICs 2 and outputs the drive timing signals to the gate driver ICs 3.

Figure 7A:
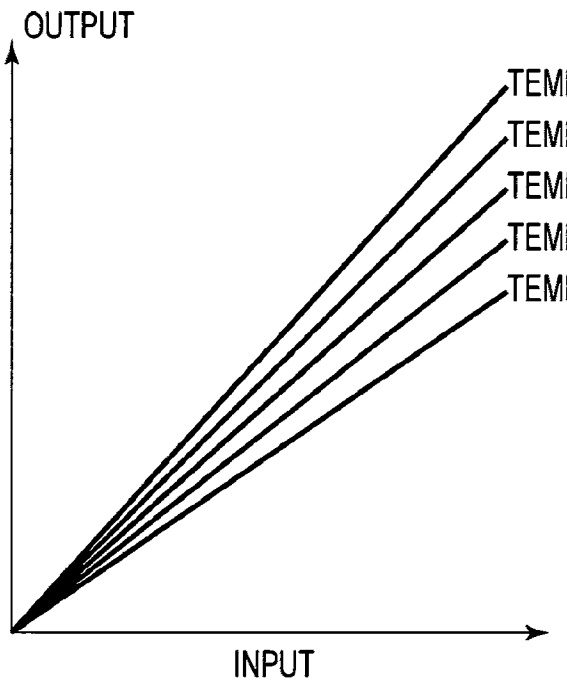
FIGS. 7A and 7B are graphs explaining temperature control of the display panel.
Figure 7B:
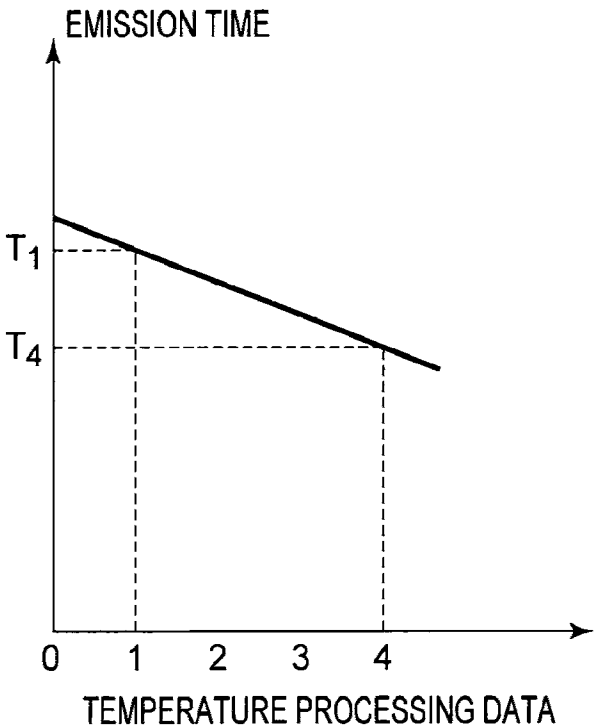

The image processing circuit 5 stores a look-up table such as shown in FIG. 4 previously formed and storing a relation between the temperature information of four bits and the temperature processing data of "0" to "4". The image processing circuit compares the temperature information of four bits input from the temperature detecting means 4 with the look-up table, selects a corresponding one of temperature processing data "0" to "4". Using the selected one of the temperature data "0" to "4", the image processing circuit 5 adjusts to lower an amplification factor for input image data as shown in FIG. 7A, or adjusts an emission time of the organic EL elements 8 as shown in FIG. 7B. In this way, it becomes possible to suppress a power consumption of the gate driver ICs 3 and suppress heat generation of the organic EL elements 8 and a temperature rise in the display panel 1. In FIG. 1, reference numeral 19 represents a D/A conversion reference voltage generator which is controlled by a reference voltage control signal from the image processing circuit 5. The D/A conversion reference voltage generator generates a reference voltage for which the data drive ICs 2 D/A convert the digital image data into analog signals, and outputs the generated reference voltage.

Next, description will be made on temperature control of the display panel 1 of the display apparatus structured as above.

For example, in a full white drive state, a peak current of the drive current i is supplied to all organic EL elements 8 of the display panel 1. Therefore, a power consumption of the gate driver ICs 3 increases and the gate driver ICs generate heat.

Heat generated by the gate driver ICs 3 is detected with the chip temperature monitor circuits 11 of the temperature detecting means 4 provided in the gate driver ICs 3. Namely, a temperature change in a forward voltage drop of the diodes changing with a temperature is detected with each thermosensitive unit 15. Each A/D converter 12 converts an analog signal output from the chip temperature monitor circuit 11 into detection data of one bit taking "1" when a temperature is high relative to a predetermined threshold value and "0" when a temperature is low. The detection data from each chip temperature monitor circuit 11 is processed and converted by the temperature information processing circuit 13 into temperature information of four bits which is in turn output to the image processing circuit 5.

The image processing circuit 5 compares the input temperature information with the look-up table (refer to FIG. 4) to select the temperature processing data. For example, if the input temperature information is "1000", the total bit is "1" so that the temperature processing data "1" is selected from the look-up table shown in FIG. 4.

In this case, for example, if an emission luminance of the organic EL elements 8 is to be lowered by adjusting an amplification factor for the image data, the amplification factors of amplifier circuits are adjusted to obtain the input/output characteristics of the image data corresponding to the temperature processing data "1", as shown in FIG. 7A. The current i to be supplied to each organic EL element 8 is therefore suppressed and a luminance of the whole screen of the display panel 1 lowers. At the same time, heat generation by the organic EL elements 8 is suppressed and a temperature of the display panel 1 is lowered.

If the input temperature information is "1111", the total bit is "4" so that the temperature processing data "4" is selected from the look-up table shown in FIG. 4. In this case, the amplification factors of amplifier circuits are adjusted to obtain the input/output characteristics of the image data corresponding to the temperature processing data "4", as shown in FIG. 7A.

Alternatively, an emission luminance of the organic EL elements 8 may be controlled by adjusting an emission time of the organic EL elements 8. In this case, if the input temperature information is "1000", this information is compared with the look-up table shown in FIG. 4 to select the temperature processing data "1". Using the look-up table such as shown in FIG. 7B previously preset and storing the relation between temperature processing data and an emission time, an emission time of $T_1$ corresponding to the temperature processing data "1" is selected. A pulse width of a scan signal to be supplied to the scan lines $DS_1$ to $DS_n$ of the gate driver IC's 3*a* to 3*d* is narrowed to set the emission time to $T_1$. An effective value of the current i to be supplied to each organic EL element 8 is therefore lowered, and a luminance of the whole screen of the display panel 1 is lowered. At the same time, heat generation of the organic EL elements 8 is suppressed and a temperature of the display panel 1 is lowered.

If the input temperature information is "1111", the temperature processing data "4" is selected from the look-up table shown in FIG. 4. In this case, using the look-up table shown in FIG. 7B, an emission time of $T_4$ corresponding to the temperature data "4" is selected.

As the temperature of the display panel 1 is suppressed and exothermic temperatures of the gate drive IC's 3 lower not higher than a reference value, the temperature information output from the temperature detecting means 4 is "0000", and the image processing circuit 5 selects the temperature processing data "0" from the look-up table shown in FIG. 4. Image data changes with the normal input/output characteristics corresponding to the temperature processing data "0", and the emission time recovers a normal emission time. The above-described operations are repeated so that a luminance and a temperature of the display panel 1 are maintained in an optimum state.

Figure 8:
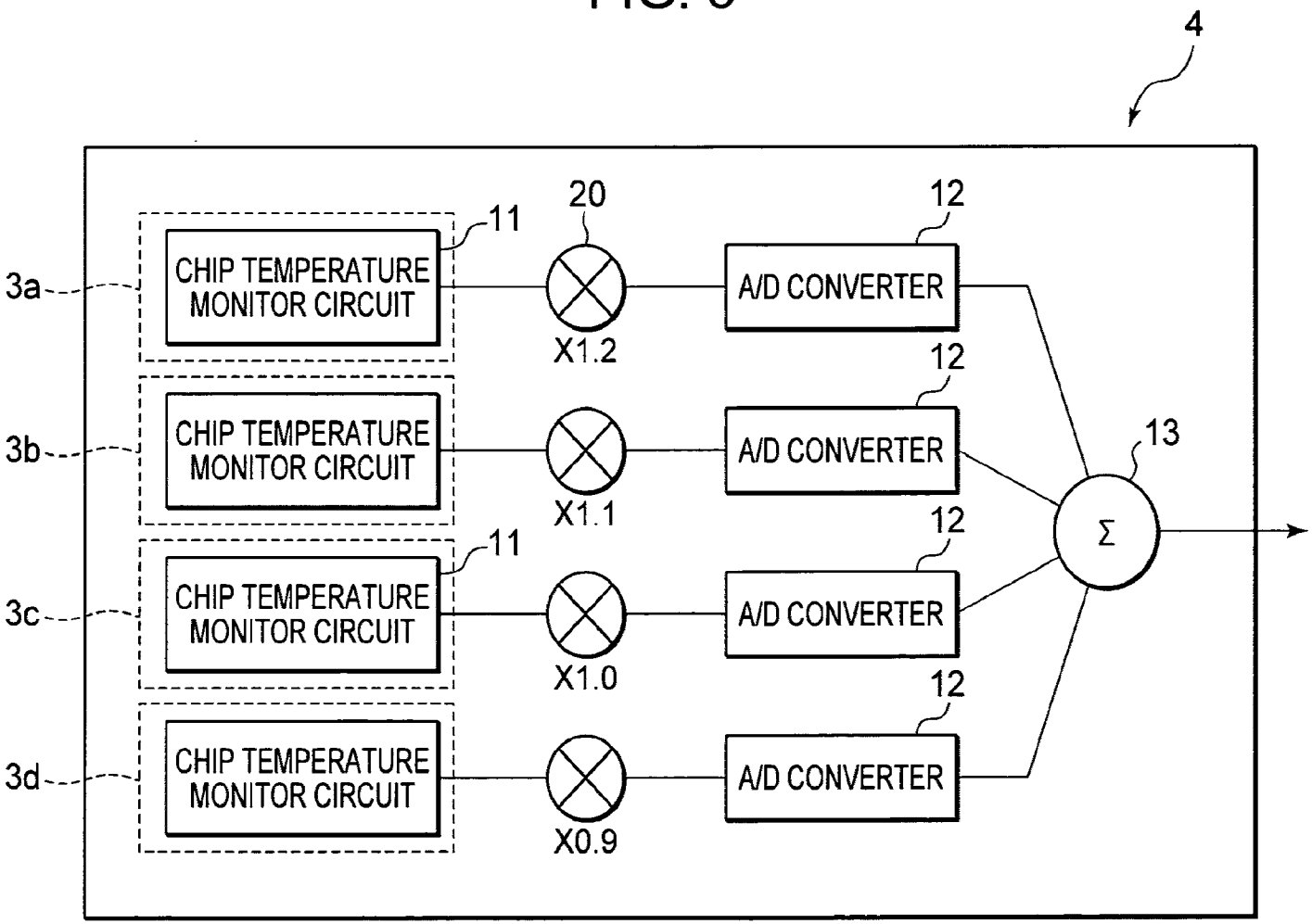
FIG. 8 is a block diagram showing another example of the structure of a temperature detecting means.

FIG. 8 is a block diagram showing another example of the structure of the temperature detecting means 4. The temperature detecting means 4 can obtain temperature information added with weighted position information. With this weighting, detection data of the exothermic temperature caused by power consumption of each gate driver IC 3 is made larger for the gate drive IC 3 in an upper area of the display panel 1. A multiplier 20 is inserted between the chip temperature monitor circuit 11 and A/D converter 12, and a temperature detection sensitivity of each chip temperature monitor circuit 11 is substantially changed by weight coefficients of x1.2, x1.1, x1.0 and x 0.9.

Figure 9:
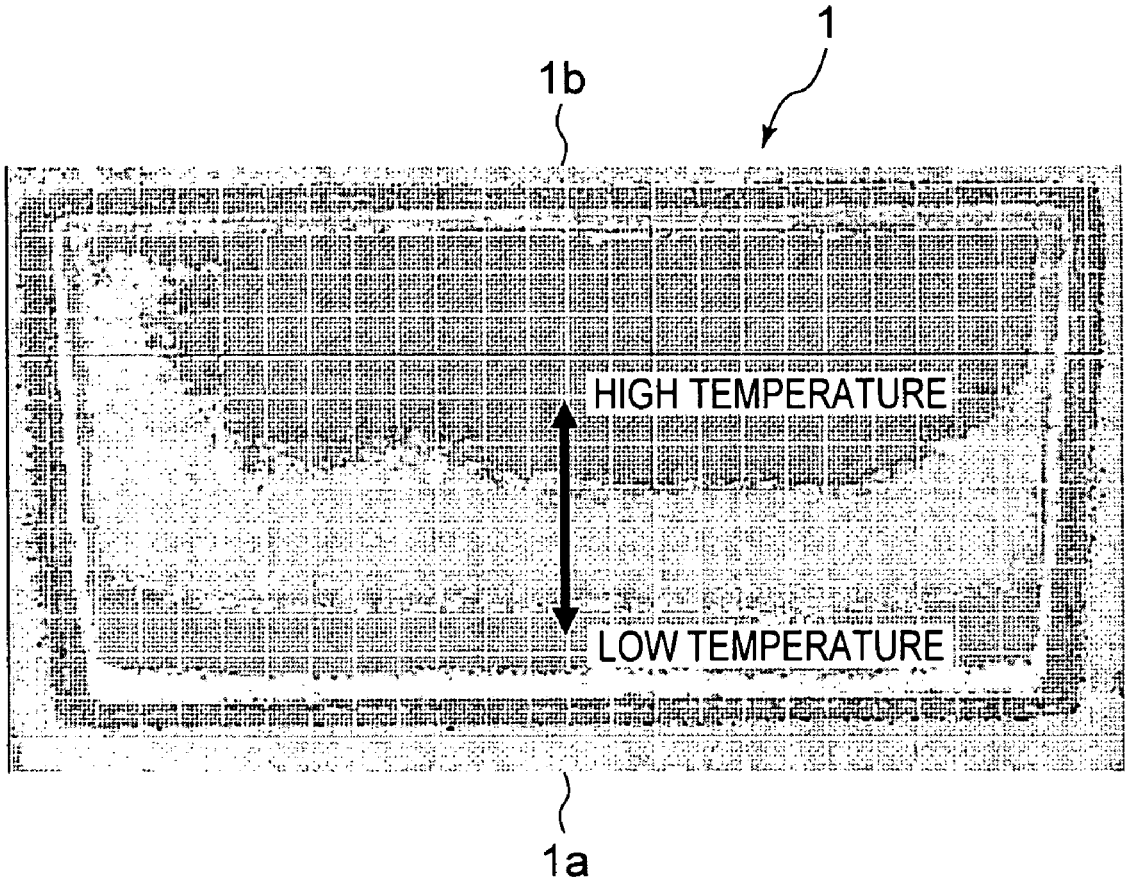
FIG. 9 is an illustrative diagram showing a surface temperature distribution of a large size or high luminance display panel.

Generally, as shown in FIG. 9, a large size or high luminance display panel 1 has a tendency that a surface temperature becomes higher from a lower end 1*a* toward an upper end 1*b*, as shown in FIG. 9. As shown in FIG. 8, weighting is performed in such a manner that a temperature detection sensitivity of the chip temperature monitor circuit 11 of the gate driver IC is improved more for the gate driver IC 3*a* covering the upper area of the display panel 1. The temperature detecting means 4 structured as above outputs temperature information of four bits similar to that described earlier, and temperature control of the display panel 1 is performed by referring to the look-up table shown in FIG. 4 using the temperature information.

In the above description, temperature information is obtained through weighting making the detection data of an exothermic temperature be larger for the gate driver IC 3 corresponding to an upper area of the display panel 1. The present invention is not limited thereto, but a temperature of each gate driver IC 3 may be detected without weighting, and by referring to a look-up table shown in FIG. 10 previously formed and stored, temperature control of the display panel 1 is performed. This look-up table has temperature information added with weighted position information. With this weighting, detection data of the exothermic temperature of each gate driver IC 3 is made larger for the gate drive IC 3 in an upper area of the display panel 1.

In this case, if the temperature information input from the temperature detecting means 4 is "1000", weighting information of "1.2, 0.0, 0.0, 0.0" is selected and the temperature processing data of "1.2" is selected. In this manner, the amplification factors of amplifier circuits are adjusted so that the input/output characteristics of image data shown in FIG. 7A corresponding to the temperature processing data "1.2" are selected. An emission time corresponding to the temperature processing data "1.2" is selected from the look-up table shown in FIG. 7B.

In the embodiments described above, detection data of each chip temperature monitor circuit 11 is set to one bit. The present invention is not limited thereto, but the detection data may be constituted of a plurality of bits, or an analog value may be output as the detection data. In this case, a precision of temperature information is improved further.

In the embodiments described above, although temperature control of the display panel 1 is performed by adjusting either the amplification factor for image data or an emission time, the present invention is not limited thereto, but both the amplification factor and emission time may be adjusted.

In the embodiments described above, the chip temperature monitor circuit 11 is provided in the gate driver IC 3. The present invention is not limited thereto, but the chip temperature circuit 11 may be mounted on the surface of the gate driver IC 3. In this case, the chip temperature monitor circuit 11 is not limited to the diode structure changing a forward voltage drop with a temperature. For example, a temperature detector sensor such as a thermo couple may be used.

In the embodiments described above, as the temperature detecting means, the thermosensitive unit 15 for detecting an exothermic temperature of the gate driver IC 3 is equipped in the gate driver IC 3. The embodiments of the present invention are not limited thereto, but a consumption power detector circuit for detecting a consumption power of the gate driver IC 3 may be equipped in a drive current input portion to the gate driver IC 3. In this case, since a consumption power of the gate driver IC 3 can be detected directly, a detection sensitivity can be improved.

In the embodiments described above, although the organic EL elements 8 are used as light emitting elements, the embodiments of the present invention are not limited thereto, but a light emitting element may be any type so long as a luminance is controlled by a current value.

EXAMPLES OF APPLICATIONS

The display device of one embodiment of the present invention described above is applicable to various electronic apparatus shown in FIGS. 11 to 15 in all fields, in which a video signal input to an electronic apparatus or generated in an electronic apparatus is displayed as images or pictures, such as a digital camera, a note type personal computer, a portable terminal apparatus such as a mobile phone, and a video camera. Description will be made on examples of an electronic apparatus to which one embodiment of the present invention is applicable.

Figure 11:
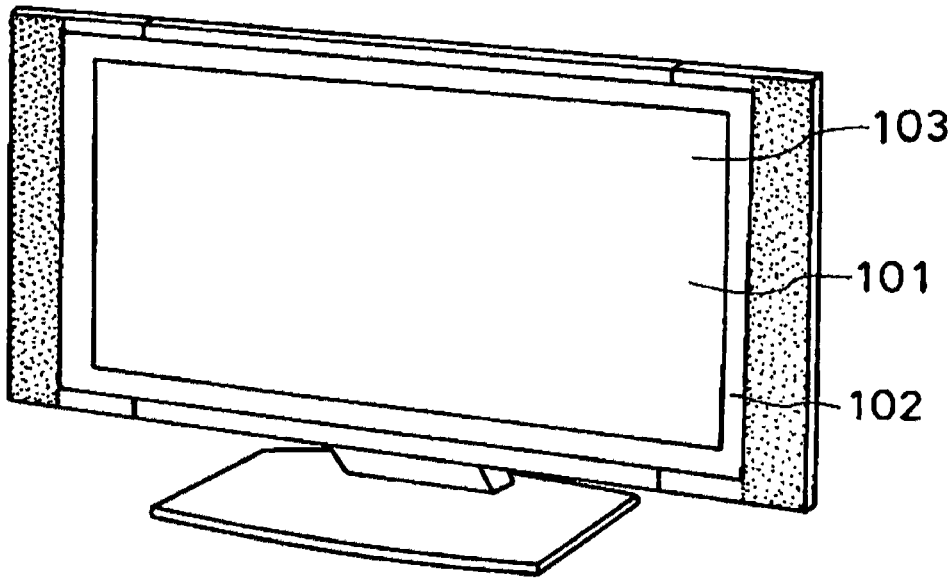
FIG. 11 is a perspective view of a television set applying the display device of one embodiment of the present invention.

FIG. 11 is a perspective view of a television set to which the display device of one embodiment of the present invention is applied. The television set of this application example has an image display screen 101, a front panel 102, a filter glass 103 and the like. The image display screen 101 is formed by using the display device of the present invention.

Figure 12A:
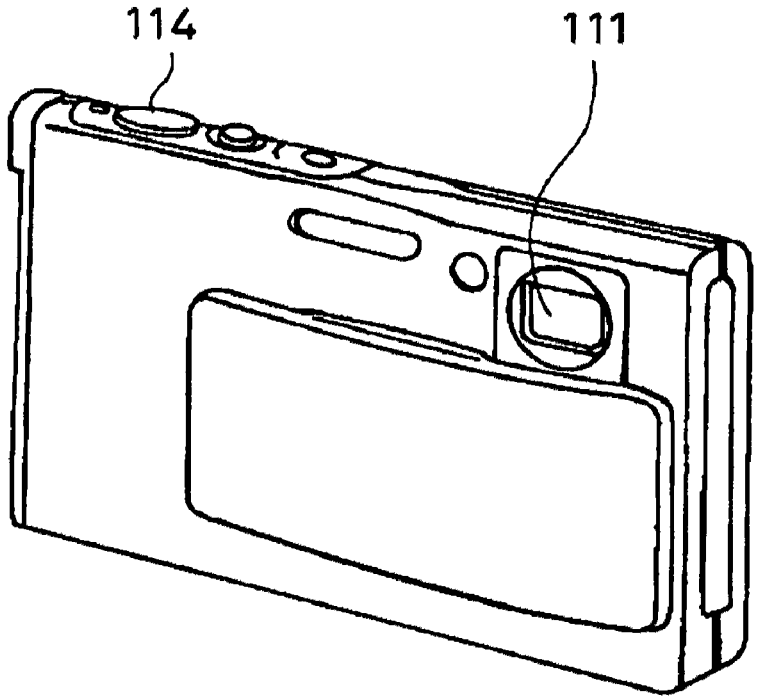
FIG. 12 is a perspective view of a digital camera applying the display device of one embodiment of the present invention.
Figure 12B:
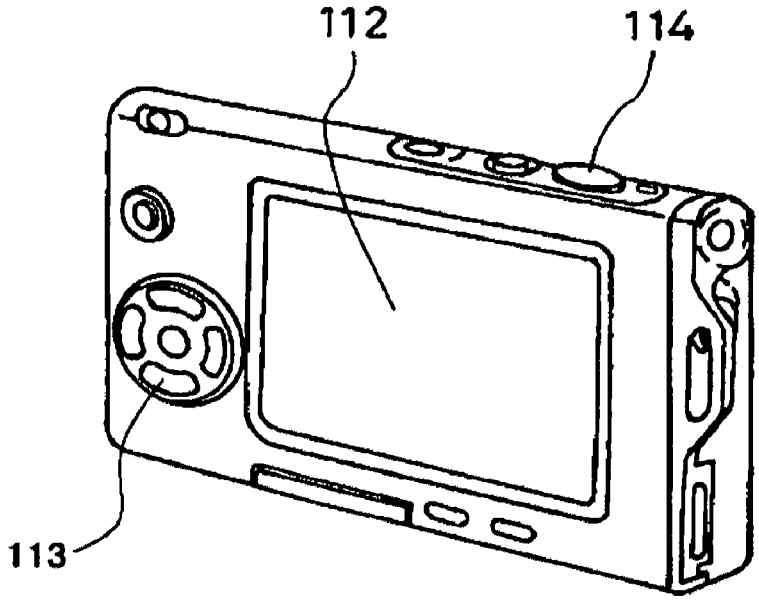

FIGS. 12A and 12B are perspective views of a television set to which the display device of one embodiment of the present invention is applied, FIG. 12A is a perspective view as viewed from the front side, and FIG. 12B is a perspective view as viewed from the back side. The digital camera of this application example has a taking lens 111, a display unit 112, a menu switch 113, a shutter button 114 and the like. The display unit 112 is formed by using the display device of the present invention.

Figure 13:
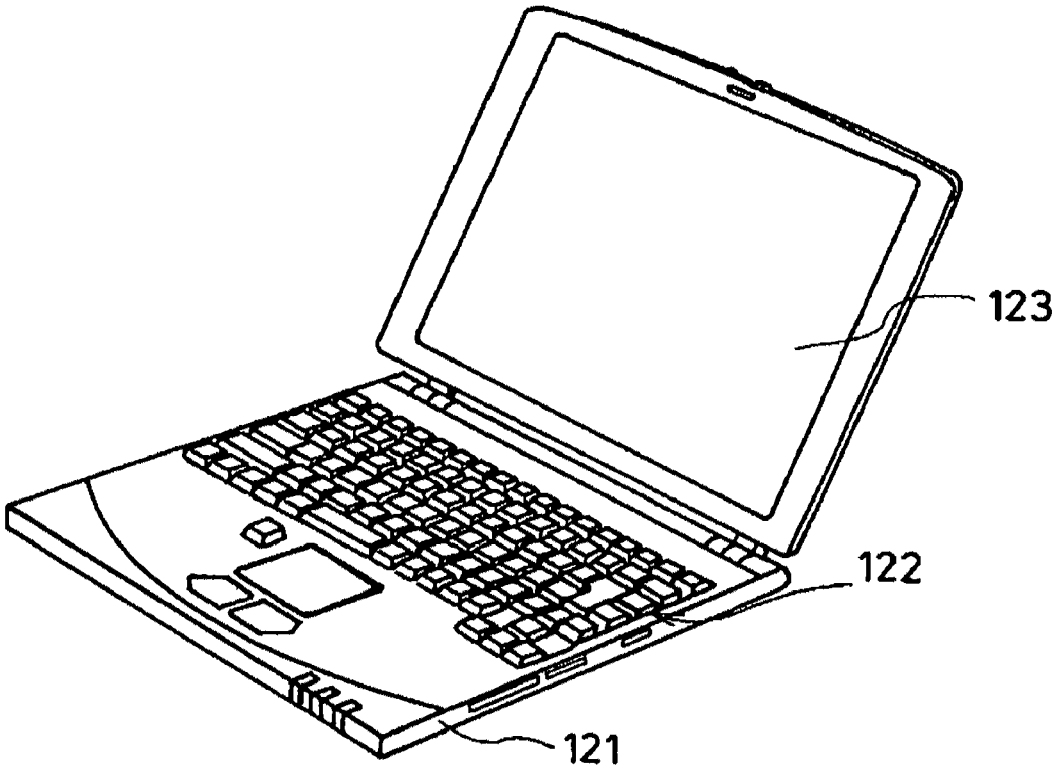
FIG. 13 is a perspective view of a note type personal computer applying the display device of one embodiment of the present invention.

FIG. 13 is a perspective view of a note type personal computer to which the display device of embodiment of the present invention is applied. The note type personal computer of this application example has a main unit 121, a keyboard 122 to be used for entering characters and the like, a display unit 123 for displaying an image, and the like. The display unit 123 is formed by using the display device of one embodiment of the present invention.

Figure 14:
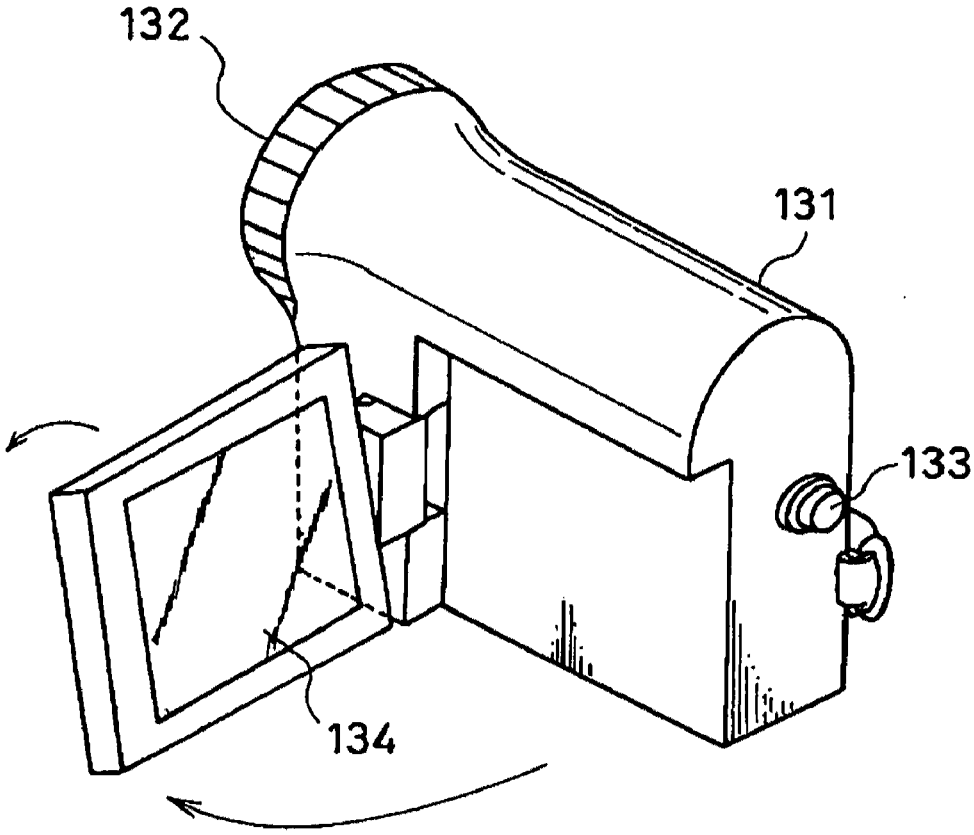
FIG. 14 is a perspective view of a video camera applying the display device of one embodiment of the present invention.

FIG. 14 is a perspective view of a video camera to which the display device of one embodiment of the present invention is applied. The video camera of this application example has a main unit 131, a lens 132 mounted on the front side for taking an object, a start/stop switch 133 to be used during photographing, a display unit 134 and the like. The display unit 134 is formed by using the display device of one embodiment of the present invention.

Figures 15A, 15B, 15C, 15D, 15E, 15F, 15G:
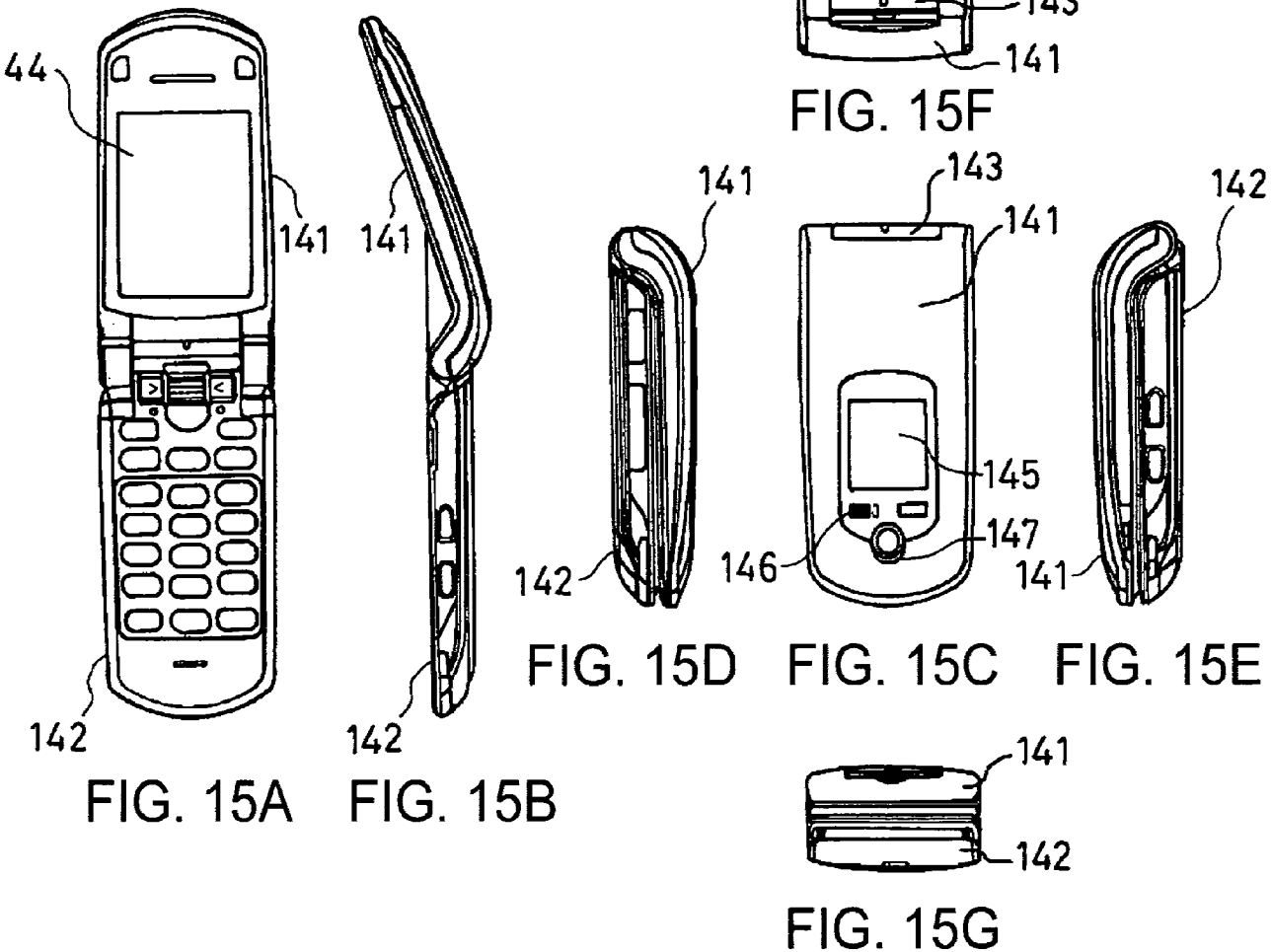
FIG. 15 is an illustrative diagram of a portable terminal apparatus applying the display device of one embodiment of the present invention.

FIGS. 15A to 15G show a portable terminal apparatus, e.g., a mobile phone, to which the display device of one embodiment of the present invention is applied. FIG. 15A is a front view in an open state, FIG. 15B is a side view, FIG. 15C is a plan view in a close state, FIG. 15D is a left side view of FIG. 15C, FIG. 15E is a right side view of FIG. 15C, FIG. 15F is a back view of FIG. 15C, and FIG. 15G is a front view of FIG. 15C. The mobile phone of this application example has an upper housing 141, a lower housing 142, a coupling unit (hinge unit) 143, a display 144, a sub-display 145, a picture light 146, a camera 147 and the like. The display 144 and sub-display 145 are formed by using the display device of one embodiment of the present invention.

It should be understood by those skilled in the art that various modifications, combinations, sub-combinations and alternations may occur depending on design requirements and other factors insofar as they are within the scope of the appended claims or the equivalents thereof.

The present application claims benefit of priority of Japanese patent Application No. 2006-341063 filed in the Japanese Patent Office on Dec. 19, 2006, the entire content of which being incorporated herein by reference.

What is claimed is:

1. A display device comprising:

a display panel;

a plurality of light emitting elements disposed in a matrix form on the display panel;

a plurality of driver ICs that supply a current to the light emitting elements;

detecting means for detecting a rise in temperature of each of the driver ICs and outputting temperature information; and an image processing circuit for controlling the current to the light emitting elements based on the temperature information output from the detecting means, wherein the detecting means includes a thermosensitive unit provided in each of the driver ICs for detecting a rise in temperature of each of the driver ICs.

2. The display device according to claim 1, wherein the thermosensitive unit has a diode structure changing a forward voltage drop with a temperature.

3. The display device according to claim 2, wherein the diode structure includes a serial connection of a plurality of PNP transistors.

4. The display device according to claim 1, wherein the driver ICs are provided to correspond to a plurality of areas of the display panel divided along a horizontal direction, the driver ICs driving the light emitting elements in each corresponding area.

5. The display device according to claim 1, wherein the detecting means further includes a consumption power detecting circuit, provided in a drive current input portion to the driver IC, for detecting a consumption power of the driver IC.

6. The display device according to claim 1, wherein the image processing circuit controls the supply current to the light emitting elements by controlling an amplification factor for image data using the temperature information output from the detecting means.

7. The display device according to claim 1, wherein the image processing circuit controls the supply current to the light emitting elements by controlling an emission time of the light emitting elements using the temperature information output from the detecting means.

8. The display device according to claim 1, wherein each of the light emitting elements is an organic electro luminescence element.

9. An electronic apparatus including the display device according to claim 1.

10. The display device according to claim 1, wherein the thermosensitive unit includes a thermocouple.

11. A display device comprising:

a display panel;

a plurality of light emitting elements disposed in a matrix form on the display panel;

a plurality of driver ICs that supply a current to the light emitting elements;

a temperature detector configured to detect a rise in temperature of each of the driver ICs and outputting temperature information; and an image processing circuit for controlling the current to the light emitting elements based on the temperature information output from the temperature detector, wherein the temperature detector includes a thermosensitive unit provided in each of the driver ICs for detecting a rise in temperature of each of the driver ICs.

12. The display device according to claim 11, wherein the thermosensitive unit has a diode structure changing a forward voltage drop with a temperature.

13. The display device according to claim 12, wherein the diode structure includes a serial connection of a plurality of PNP transistors.

14. The display device according to claim 11, wherein the driver ICs are provided to correspond to a plurality of areas of the display panel divided along a horizontal direction, the driver ICs driving the light emitting elements in each corresponding area.

15. The display device according to claim 11, wherein the detecting means further includes a consumption power detecting circuit, provided in a drive current input portion to the driver IC, for detecting a consumption power of the driver IC.

16. The display device according to claim 11, wherein the image processing circuit controls the supply current to the light emitting elements by controlling an amplification factor for image data using the temperature information output from the detecting means.

17. The display device according to claim 11, wherein the image processing circuit controls the supply current to the light emitting elements by controlling an emission time of the light emitting elements using the temperature information output from the detecting means.

18. The display device according to claim 11, wherein each of the light emitting elements is an organic electro luminescence element.

19. An electronic apparatus including the display device according to claim 11.

20. The display device according to claim 11, wherein the thermosensitive unit includes a thermocouple.

* * * * *